United States Patent [19]

Rozmestor

[11] Patent Number: 4,817,809

[45] Date of Patent: Apr. 4, 1989

[54] SLIDABLY INTERLOCKING ATTACHMENT PLATES AND ITEMS

[75] Inventor: Raymond L. Rozmestor, Westville, N.J.

[73] Assignee: Advanced Concept Tools, Inc., Edgewater Park, N.J.

[21] Appl. No.: 128,917

[22] Filed: Dec. 4, 1987

Related U.S. Application Data

[63] Continuation-in-part of Ser. No. 858,166, May 1, 1986, Pat. No. 4,711,353.

[51] Int. Cl.[4] ..... B65D 21/02

[52] U.S. Cl. ..... 220/23.4; 220/23.2; 206/821; 206/503; 206/509; 224/252; 224/253

[58] Field of Search ..... 206/378, 377, 486, 493, 206/563, 564, 503, 509, 821; 224/252, 253; 403/292, 294, 314; 220/23.83, 23.2, 23.4; 294/89, 137, 145, 158, 159, 162

[56] References Cited

U.S. PATENT DOCUMENTS

| | | | |
|---|---|---|---|
| 299,381 | 5/1884 | Grove | 403/294 |
| 1,281,299 | 10/1918 | Crossman | 224/253 |
| 2,758,798 | 8/1956 | Schmidt | 206/349 |
| 2,776,792 | 1/1957 | Pearson | 294/158 |
| 3,182,856 | 5/1965 | Goltz | 206/509 |
| 3,339,608 | 9/1967 | Brenner | 206/349 |
| 3,533,541 | 10/1970 | Lerner | 294/158 |
| 3,599,828 | 7/1969 | Conway | 220/23.4 |
| 3,642,337 | 2/1972 | Manheim | 206/509 |
| 3,650,553 | 3/1972 | Wennstrom | 403/294 |
| 3,842,981 | 10/1974 | Lambert | 220/23.83 |
| 3,982,676 | 9/1976 | Bourlet | 294/145 |
| 4,408,812 | 10/1983 | Krautwurst | 403/292 |
| 4,566,588 | 1/1986 | Kataczynski | 206/523 |
| 4,681,219 | 7/1987 | Kitchens | 206/564 |
| 4,711,353 | 12/1987 | Rozmestor | 206/378 |

FOREIGN PATENT DOCUMENTS

| | | | |
|---|---|---|---|
| 2133388 | 7/1984 | United Kingdom | 220/23.4 |

*Primary Examiner*—David T. Fidei

*Attorney, Agent, or Firm*—Fleit, Jacobson, Cohn & Price

[57] ABSTRACT

Attachment plates which are constructed to slidably interlock with various items including containers, housings, walls, fixtures and other entities in which the sliding interlocking connection includes male and female dovetailed, longitudinally wedge shaped structures with the attachment plates being capable of connecting various items, articles, containers and the like with the attachment plate including a support structure to enable the connected items to be carried or effectively supported, handled and the like with the wedge shaped configuration of the dovetailed connection providing a positive and secure interconnection between the attachment plate and the item connected thereto. The items or articles, such as containers or the like, are constructed with the wedge shaped tapered dovetailed connection facilities on surface portions thereof to enable a plurality of the items to be connected to each other or connected to the attachment plate.

6 Claims, 1 Drawing Sheet

SLIDABLY INTERLOCKING ATTACHMENT PLATES AND ITEMS

CROSS-REFERENCE TO RELATED APPLICATION

This application is a continuation-in-part of my copending application U.S. Ser. No. 858,166 filed May 1, 1986 for SOCKET ORGANIZER now U.S. Pat. No. 4,711,353 issued Dec. 8, 1987.

BACKGROUND OF THE INVENTION

1. FIELD OF THE INVENTION

The present invention generally relates to attachment plates which are constructed to slidably interlock with various items including containers, housings, walls, fixtures and other entities in which the sliding interlocking connection includes male and female dovetailed, longitudinally wedge shaped structures with the attachment plates being capable of connecting various items, articles, containers and the like with the attachment plate including a support structure to enable the connected items to be carried or effectively supported, handled and the like with the wedge shaped configuration of the dovetailed connection providing a positive and secure interconnection between the attachment plate and the item connected thereto. The items or articles, such as containers or the like, are constructed with the wedge shaped tapered dovetailed connection facilities on surface portions thereof to enable a plurality of the items to be connected to each other or connected to the attachment plate.

2. INFORMATION DISCLOSURE STATEMENT

Slidable interlocking connections have been known for various purposes such as supporting items from vertical walls and connecting items together. U.S. Pat. Nos. 3,514,170, 3,851,936 and 4,624,383 disclose structures relating to this invention including slidable interlocking connections between containers and between containers and a support. However, the structural features in the above-mentioned patents are different from the structure of the present invention. A separate information disclosure statement will be filed in this case.

SUMMARY OF THE INVENTION

An object of the present invention is to provide slidably interlocking attachment plates and items connected and supported thereby in which the slidable interconnection includes a tapered or wedge shaped dovetailed interconnection for securely and positively interconnecting and/or supporting a plurality of items so that the plurality of items are effectively connected, joined, attached and securely held or interlocked in relation to each other or attached to other items, supporting structures and the like.

Another object of the invention is to provide a slidable interlocking connection incorporated into various items such as containers, housings, fixtures and similar items which enable interlocking connection of a plurality of such items and enable an attachment plate to connect and/or support a plurality of items in an assembled, connected relation or support one or more items or articles from a supporting structure.

A further object of the invention is to provide a slidably interlocking attachment arrangement having general utility for connecting and/or supporting one or a plurality of various items, articles, housings, containers and the like which is simple in construction, effective in use and capable of many uses satisfying various use requirements.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
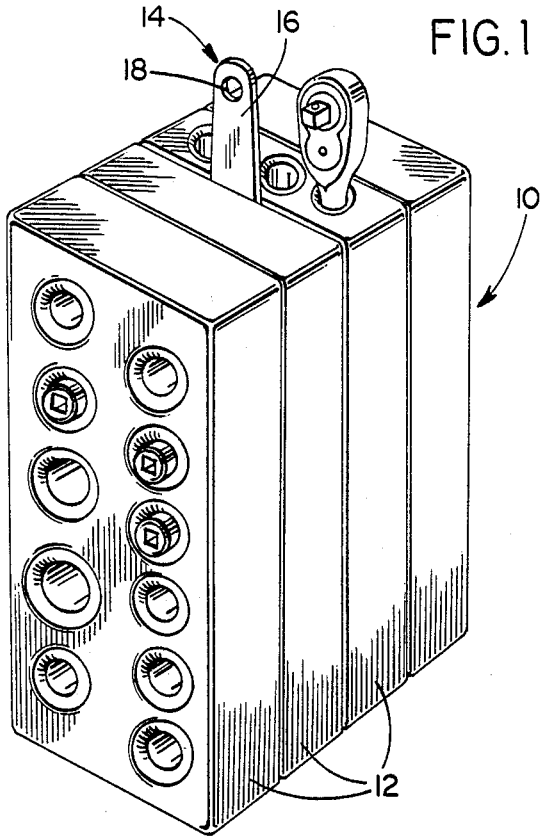
FIG. 1 is a perspective view of a plurality of items being retained in assembled relation and capable of being carried or supported by a slidably interlocking attachment plate and by a slidably interlocking connection between certain of the items.
Figure 3:
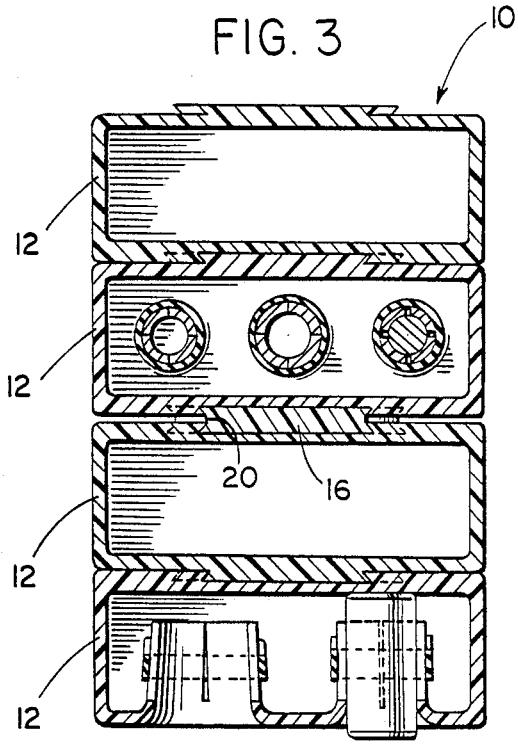
FIG. 3 is a transverse, sectional view illustrating the structure of the slidably interlocking connection utilized in this invention.
Figure 2:
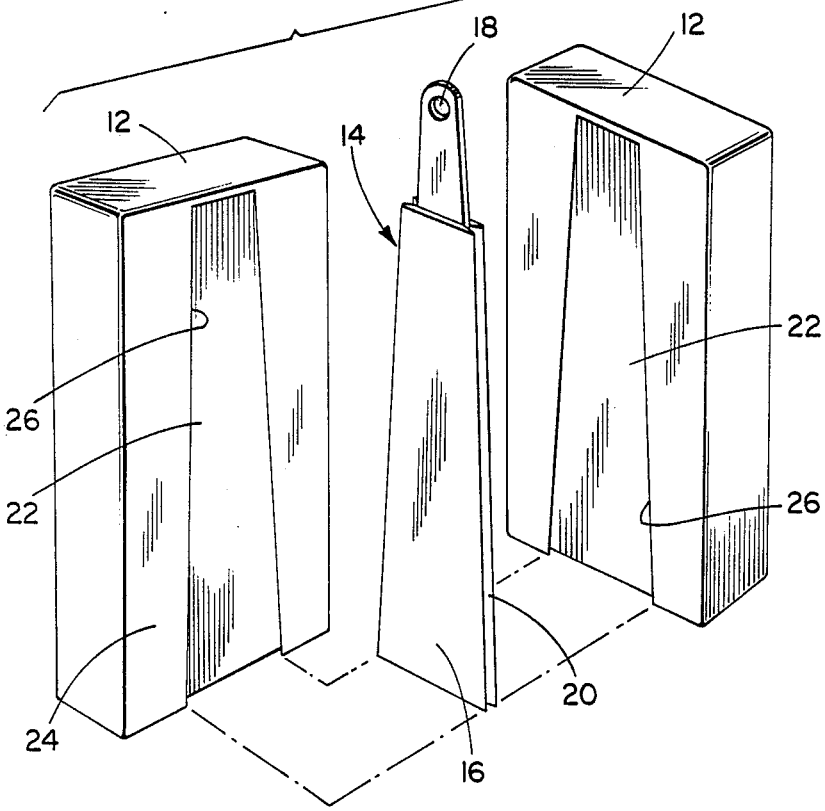
FIG. 2 is an exploded perspective view illustrating the structural arrangement of the invention.
Figure 4:
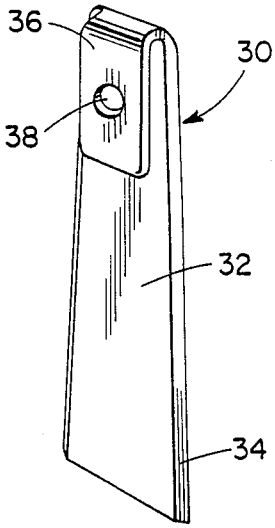
FIG. 4 is a perspective view of an attachment plate with a supporting hook associated therewith.

Referring now to the drawings, FIG. 1 illustrates an assembly 10 which includes a plurality of housings, fixtures, containers and the like each of which is designated by reference numeral 12 and which are interconnected with each other and adjacent items 12 are interconnected by an attachment plate generally designated by the numeral 14 which retains adjacent items 12 in assembled relation and thus retains the assembly in assembled relation.

The attachment plate 14 includes an elongated strip-like panel 16 which tapers from one end to the other with the narrow end of the panel 16 including an aperture 18 or other means for engagement with a support or forming a handle by which the panel 16 can be supported, lifted, manipulated and the like. The side edges of the panel 16 diverge downwardly from the apertured end to form a wedge shaped configuration and the side edges of the panel 16 are generally V-shaped as designated by numeral 20 to provide a dual or double male dovetailed member for connection with correspondingly shaped recesses 22 in adjacent surfaces 24 of adjacent items 12. Each recess 22 is provided with side edges 26 which incline inwardly from a wide end to a narrow end with the side edges of the recess also slanting downwardly and outwardly thus providing a wedge shaped, tapering female dovetailed connecting member which will receive and slidably interlock with one-half of the V-shaped edges 20 of the panel 16 so that items 12 having female recesses 22 in facing or adjacent surfaces can be slidably interlocked with the attachment plate 14. The items 14 will include a female recess on one side and a male dovetailed, tapered, wedge shaped interlocking member on the other so that one or a plurality of items 12 may be slidably interlocked with respect to each other thereby enabling a plurality of items to be assembled onto each other with the adjacent opposed items being slidably interlocked with the attachment plate 14 thereby providing an assembly 10 of items 12 so that a plurality of such items may be interconnected to form an assembly, package or containers and a plurality of such items or the assembly may be supported, handled, lifted, manipulated and the like in any suitable manner but yet readily disassembled for individual use.

One mode of use is the assembly of a plurality of article holders for small tools such as wrence sockets, ratchet handles, extensions and the like having article holders incorporated therein as disclosed in my copending application previously mentioned.

An alternative attachment or support plate 30 can be provided in which the configuration of the strip-like panel 32 is the same except that the side edges thereof are beveled or inclined as at 34 rather than being V-shaped since the upper end of the panel 32 is reversely folded or curved to form a supporting hook 36 which may have an aperture 38 in the downturned end thereof to facilitate engagement with a support structure, a handling or lifting structure or any other structure to support, handle or manipulate the attachment plate 30 and one or more items connected thereto by the slidably interlocked, wedge shaped, tapered dovetailed connection. Another alternative is to provide apertures in the plate or panel 14 or 32 for receiving screws to attach the plate to a supporting surface in which event the reversely curved or folded hook 36 would be omitted. This structure enables one or more items to be connected to a supporting surface such as a vertical or horizontal surface by slidably interlocking the male dovetailed member with a female tapered dovetailed recess in the surface of an item 12.

As indicated, the items 12 may be containers, housings, fixtures or any other article, items or entity desired to be connected to similar or dissimilar entities, supported or connected to each other and supported or connected to a supporting structure or the like.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A slidably interlocking attachment plate and item connected thereto comprising a strip-like panel having converging side edges extending from one end toward the other end to form a wedge shaped plate with the side edges being inclined from one surface toward the other to form a wedge shaped male dovetailed connecting member, said item including a recess in a surface thereof with the side edges of the recess converging from one end toward the other end to form a wedge shaped recess and the side edges of the recess being inclined from an outer surface to an inner surface and oriented in diverging relation to form a female, wedge shaped dovetailed connecting member for receiving the plate therein for connecting the plate and item by longitudinal relative sliding movement of the plate and item with the male dovetailed member telescoped into the female dovetailed member, means including a transverse surface on the plate and in the recess which engage to provide a positive limit to movement of the plate into the recess and end means on the narrow end of said plate extending axially outwardly of the item and panel to provide access to the plate to enable manipulation of the plate and item.

2. The structure as defined in claim 1 wherein said plate side edges are of V-shaped configuration forming a dual, wedge shaped, male connecting member for slidably interlocking connection with a recess in the surface of adjacent opposed items to enable one or more items to be supported from the plate thereby securely connecting, joining and holding one or more items in assembled relation to the plate.

3. The structure as defined in claim 1 wherein said in means includes a reversely extending free end portion defining a hook on the end of the plate.

4. The structure as defined in claim 1 wherein said in means includes an aperture in an extended narrow end of the plate.

5. An assembly comprising a plurality of items having tapered, wedge shaped slidably interlocking dovetailed connecting assemblies therebetween and an attachment plate having a dual, wedge shaped, dovetailed connecting member incorporated into the side edges thereof for connecting two items together in opposed relation in which each of the items includes a female, wedge shaped, dovetailed connecting member incorporated therein and lifting and handling means at the narrow end portion of said plate for lifting and handling said plate and items connected thereto, said means extending outwardly beyond the confines of the items to provide access to said means.

6. In combination, a pair of items having generally flat, opposed surfaces, and means detachably connecting said items together and enabling said items to be lifted, handled and manipulated, said connecting means comprising a longitudinally extending recess in each of the opposed surfaces extending inwardly from one edge thereof and terminating inwardly of an opposite edge, said recess being defined by a pair of side edges which converge longitudinally and diverge laterally to form a female, wedge shaped recess in each surface, and a connector plate comprising a panel having longitudinally converging side edges, each plate side edge having a V-shaped configuration for sliding interlocking engagement with the recesses to retain the items and plate in connected relation, said connector plate including an end portion at the narrow end thereof projecting beyond the confines of the items to provide access to the connector plate to facilitate assembly and disassembly of the items and plate and to enable the assembled items and plate to be lifted, handled and manipulated.

* * * * *